US005202160A

United States Patent [19]

Schuppe et al.

[11] Patent Number: 5,202,160

[45] Date of Patent: Apr. 13, 1993

[54] HOLDBACK CONTROL IN APPARATUS FOR COATING THE INTERNAL SURFACES OF METAL TUBES

[75] Inventors: James L. Schuppe; David M. Kolaga, both of Milwaukee, Wis.

[73] Assignee: Inductametals Corporation, Chicago, Ill.

[21] Appl. No.: 705,494

[22] Filed: May 24, 1991

[51] Int. Cl.[5] ..... B05D 7/22

[52] U.S. Cl. ..... 427/231; 118/68; 118/215; 118/306; 118/317; 118/DIG. 10; 427/591

[58] Field of Search ..... 118/65, 68, 215, 306, 118/317, 666, DIG. 10, 620; 427/230, 233, 231, 46

[56] References Cited

U.S. PATENT DOCUMENTS

| | | | |
|---|---|---|---|
| Re. 24,852 | 8/1960 | Armstrong et al. . | |
| 2,822,291 | 2/1958 | Hahn . | |
| 2,845,366 | 7/1958 | Schroeder . | |
| 3,007,810 | 11/1961 | Hobrock | 427/233 |
| 3,063,860 | 11/1962 | Gemmer . | |
| 3,158,499 | 11/1964 | Jenkin . | |
| 3,207,618 | 9/1965 | De Hart . | |
| 3,218,184 | 11/1965 | Lemelson . | |
| 3,359,943 | 12/1967 | Briggs et al. . | |
| 3,394,450 | 7/1968 | Gill et al. . | |
| 3,405,000 | 10/1968 | Jacobson . | |
| 3,532,531 | 10/1970 | Stallard . | |
| 3,654,895 | 4/1972 | Bloom et al. . | |
| 3,814,616 | 6/1974 | Kondo et al. . | |
| 3,974,306 | 8/1976 | Inamura et al. . | |
| 3,982,050 | 9/1976 | Kato et al. . | |
| 4,071,641 | 1/1978 | Susai . | |
| 4,076,136 | 2/1978 | Jenkin . | |
| 4,122,798 | 10/1978 | Gibson . | |
| 4,169,906 | 10/1979 | Hallstrom et al. . | |
| 4,174,410 | 11/1979 | Smith . | |
| 4,197,336 | 4/1980 | Savchenko et al. . | |
| 4,243,699 | 1/1981 | Gibson . | |
| 4,302,482 | 11/1981 | Heck . | |
| 4,426,569 | 1/1984 | Miller et al. | 118/666 |
| 4,490,411 | 12/1984 | Feder . | |

*Primary Examiner*—W. Gary Jones
*Assistant Examiner*—Charles K. Friedman
*Attorney, Agent, or Firm*—Fitch, Even, Tabin & Flannery

[57] ABSTRACT

Apparatus for internally coating a pipe, comprising electric heating means heating a pipe as it is internally spray coated, a plurality of first rollers mounted on a first rotatable shaft having an inlet end proximate the heating means and an outlet end spaced from the heating means, and a plurality of second rollers mounted on a second rotatable shaft parallel to the first shaft and having an inlet end adjacent the heating means. Each second roller is spaced from and adjacent to a corresponding first roller in a paired relationship to thereby define a nesting groove located above the gap between each set of paired rollers. Motive means rotates the shafts and the mounted rollers to rotate the pipe within the nesting grooves of adjacent pairs of rollers. Axial advancing means longitudinally advances the pipe through the heating means and sequentially along the nesting grooves of adjacent pairs of rollers. A movable holdback means is located on the outlet side of the heating means for restraining the advancement of the pipe to a predetermined rate of speed sufficient to insure application of a uniform thin coating of coating material on the pipe internal surface, thereby overcoming thermal and magnetic effects of the heating means which would otherwise advance the pipe faster than the speed of the axial advancing means.

27 Claims, 1 Drawing Sheet

HOLDBACK CONTROL IN APPARATUS FOR COATING THE INTERNAL SURFACES OF METAL TUBES

FIELD OF THE INVENTION

The present invention relates to the metalizing of the interior of tubular metal bodies, such as pipes and tubes. More particularly, the present invention relates to method and apparatus for metalizing the interior surface of tubular bodies to produce interiorly metalized articles, such as chrome plated pipes, tubes, and segments thereof. In particular, the present invention relates the metalizing of interior surfaces of tubular products with corrosion resistant and abrasion resistant metals to provide for extended life for the tubular products in their environment of use.

BACKGROUND OF THE INVENTION

There are many fields of manufacture in which the interior of a base body, such as a pipe or tube, or a segment thereof, is metalized over an ordinary metal such as steel with an expensive surface layer treatment or coating that is fused to the base metal in order to provide a finished, or partly finished, part or product that will respond to manufacturing specifications, but which is less expensive than making the entire body of the same material that the coating specifications require. Thus, parts such as the interior of pipes or tubes used to convey corrosive or abrasive fluids, liquids, slurries and the like, are frequently required to provide thereon an interior metalized surface of chromium, or chrome, or other special metal or metal alloy, that will either resist corrosion and wear or will provide a good bearing surface. In strings of pipe used in deep oil wells, for example, it is desirable that the interior surface of the pipe have resistance to corrosion and wear, so as to extend the time period during which a string of pipe will function before corrosion or abrasive failure causes disruption of oil production and consequent increase of costs. Similarly, strings of pipe which are used to transport concrete slurry from a source of supply to the site of use, must have a wear resistant inner surface in order to withstand the abrasion of the inner surface which is caused by the aggregate (sand, gravel, and crushed stone) which is mixed with the cement in the concrete slurry.

It has been long known that ordinary steels, except for leaded steels or resulphurized steels, may be chrome surfaced by plating or the like, to meet the specifications for desired strength of the part and provide the surface character specially required for exposure to a harsh environment in which the part is to be used.

However, chromium, for example, is a relatively expensive material, and the use of chromium in various chemical baths by which chrome plating may be effected, is environmentally undesirable, operationally difficult and expensive to control. Also, it is technically difficult to deposit a metalizing layer of any substantial thickness onto the interior surface of tubes or pipes, or segments thereof, that are to serve as the bearing surface of a bearing or journal element.

While metalizing the exterior surface of bars and rods avoids, to substantial extent, the undesirable environmental effects associated with chemical plating of such bodies, the mechanical metalizing techniques previously employed in metalizing such bars and rods have usually used an open flame torch that burns fuel gases, such as acetylene, propane, or the like in the presence of oxygen, to both preheat the body surface to an elevated temperature and to heat the surface application material, which is initially in powder form, to a temperature at which the powdered coating material will become at least partially molten and fuse onto the base material of the body. These prior art metalizing techniques have not been wholly successful for economically metalizing the exterior of tubes, since the heat of a torch will frequently burn through the wall of the tube. It will be understood that such prior art metalizing techniques also generally are not successful in metalizing the interior of elongated tubes and pipes, since access to the interior of such elongated bodies with an open flame torch is very difficult, if at all possible.

The problems with such a prior technique for metalizing exterior surfaces are that there is both lack of accurate control of the thickness of the layer of the surface application material to the underlying body, and resultant lack of uniformity of the thickness of the layer that is applied by open torch heat. Furthermore, the minimum thickness of the layer of applied material usually obtained by metalizing with an open flame torch working with powdered metal, is about 0.008 inch, and the maximum thickness of a layer of applied metal is about 0.015 inch, both of which thickness values are frequently much greater than the thickness of the applied material layer which is required to be supplied to meet the performance specifications for the metalized part, and this substantially increases the cost of manufacture.

A further problem is that when using fine particles of metalizing materials to form a fused surface on an underlying body, the torch heat intensity is frequently so great that it vaporizes or burns away a substantial quantity of the finest particles of the metalizing material, thereby resulting in loss of the coating material and economic waste. Still another problem is that, in the event a thick layer of metalizing is required to be deposited, there is insufficient control over the thickness of metal being deposited and, therefore, maintaining the concentricity of the inner surface of a metalized sleeve or journal is difficult, and machining or other expensive finishing operations must be resorted to in order to obtain a high degree of concentricity of the innermost surface of an arcuate part that has been metalized.

Other techniques are also available for metalizing with a vapor, either in an inert atmosphere or under vacuum. Such processes include chemical vapor deposition and physical vapor deposition, as by evaporation, ion plating, and sputtering. The products of these processes are coatings and free-standing shapes such as sheet, foil and tubing of thicknesses ranging from 20 nm to 25 mm. However, these processes do not lend themselves readily to the metalizing of the internal surface of long lengths of pipe or tubing.

An improved method of metalizing the interior of metal bodies is disclosed in U.S. Pat. No. 4,490,411 to Feder, which discloses an apparatus and method for metalizing the interior of pipes or tubes using powdered metal. The base metal pipe or tube which is to be internally metalized is moved axially while simultaneously being rotated at a relatively high rpm. A first preheat means, preferably comprising an induction heater, heats a portion of the pipe and its interior to a first elevated temperature, and the particles of the metalizing powder are deposited into the interior of the pipe to be heated to the first elevated temperature. The rotation of the pipe distributes the fluidized particles into laminae which under further influence of centrifugal forces, automatically distributes the semi-fluidized particles effectively. The fluidized metalizing material is bonded together and to the body substrate by application of a second induction heat at a higher temperature at which the bonding then occurs between the laminae of the metalizing material and between the metalizing material and the base material of the tube or pipe. Preferably, the process is performed in the presence of a non-oxidizing gas such as preheated nitrogen, neon, or argon.

Two means are disclosed for delivering the metalizing powder to the interior of the pipe to be metalized. In on embodiment, the metalizing powder is conveyed to the interior of the pipe by means of a cantilevered boom or supply-support tube through which the metalizing powder, entrained in a stream which includes a pressurized non-oxidizing gas, is delivered in the form of a spray or shower from a nozzle in the interior of the pipe at a station located laterally or axially between the two electrical induction heating coil means, with the first such induction heating means being a preheater and the second induction heating means being the metalizing heater for accomplishing the metal fusion. In the second embodiment, an elongated auger tube and concentric auger are utilized for delivering metalizing powder to the desired point of discharge between the first induction coil and the second induction coil.

Although the method and apparatus embodiments of U.S. Pat. No. 4,490,411 are capable of producing internally metalized pipe of acceptable quality, the patent teaches a method and apparatus for supporting, rotating, and axially advancing the pipe which is being metalized where these three functions are all accomplished by a single mechanism. This mechanism comprises a set of angular pipe-rotating means which are shown in FIG. 1 of the patent adjacent the left hand of the drawing. The means include a pair of pipe engaging drive rollers 14 located on opposite sides of the pipe 10 which is being coated, and frictionally engaging the pipe 10 in part below the midheight of the pipe so that the roller engagement with the pipe also serves as a support. The rollers are driven by any convenient well known means, such as electrical motors 16, at a high speed and selective speed control may be effected by techniques well known in the art. The direction of rotation of the angled drive rollers is indicated by the arrows 18 in FIG. 1 and they bring about the rotation of the pipe 10 and simultaneous axial movement of the pipe 10 as indicated generally by the spiral or helical arrow 20 which is shown associated with pipe 10 in FIG. 1. Because the rollers 14 are angularly oriented on the cylindrical surface of the pipe, they simultaneously rotate the pipe and axially advance the pipe through the heating zone.

It has been determined that this method and apparatus technique may create a potential problem, since the single unit is simultaneously rotating and pushing the pipe through the heating zone. Because the heating zone imposes sufficient heat to melt and fuse the powdered metal coating, the wall of the pipe 10 will approach a state of plasticity, so that the combination of rotation and axial advancement of the pipe by the single roller assembly can cause physical distortion and damage to the pipe at the zone of plasticity due to the simultaneous imposition of torsional and compressive forces applied by the angled roller assembly.

In order to avoid this potential problem, a coating apparatus has been fabricated and operated which comprises a plurality of first rotatable rollers mounted on a first rotatable shaft having an inlet and an outlet end, and a plurality of second rotatable rollers mounted on a second rotatable shaft having an inlet end adjacent the inlet end of the first rotatable shaft, and having an outlet end adjacent the outlet end of the first rotatable shaft. Each second roller is spaced from and adjacent to a corresponding first roller in a paired relationship to thereby define a gap of fixed dimension between each pair of adjacent first and second rollers. A single heating means which is operable to melt and fuse the powdered metal coating to the inside surface of a rotating pipe is located proximate the outlet ends of the first and second shafts. Preferably, the single heating means is an induction heater containing one or more induction coils for heating a rotating pipe as it passes through the center of the coils.

A plurality of third rollers mounted on a third rotatable shaft having an inlet end proximate the induction heating apparatus and having an outlet end spaced from the heating apparatus is paired on the discharge side of the induction heating apparatus with a plurality of fourth rollers mounted on a fourth rotatable shaft having an inlet end adjacent the inlet end of the third rotatable shaft, and having an outlet end adjacent the outlet end of the third rotatable shaft. Each fourth roller is spaced from and adjacent to a corresponding third roller in a paired relationship to thereby define a gap of the fixed dimension between each pair of adjacent third and fourth rollers.

A nesting groove is located above the gap between each pair of rotatable rollers and between the adjacent portion of the upper surfaces of each pair of rotatable rollers. A first motive means is typically utilized for rotating the first and second rotatable shafts and the mounted first and second rollers to thereby rotate an elongated tubular body, such as a pipe or tube, within the nesting grooves of adjacent pairs of first and second rollers, and a second motive means is typically utilized for rotating the third and fourth rotatable shafts and the mounted third and fourth rollers to thereby rotate the elongated tubular body within the nesting grooves of the adjacent pairs of the third and fourth rollers.

A separate individual axial advancing means is used for longitudinally advancing the rotating elongated tubular body sequentially along the nesting grooves between adjacent pairs of first and second rollers, through the induction heating means, and sequentially along the nesting grooves between adjacent pairs of third and fourth rollers. Finally, the means for internally coating the elongated tubular body is a spray head which is located within the heating element for depositing the particulate coating material on the inside surface of the pipe.

While this modified apparatus has been successful in eliminating the problem which may be encountered by use of the angular rotational apparatus disclosed in U.S. Pat. No. 4,490,411 of distorting and damaging the rotating and axial advancing pipe in the heated region of plasticity, a new and different problem has been encountered with the modified apparatus.

It has been found that as the heated rotating pipe is discharged from the induction heating means, there is an acute problem which arises due to the presence of a magnetic field which is imposed upon the hot pipe as it is advancing along the sequence of nesting grooves between the third and fourth rollers on the discharge side of the heating unit. This magnetic field typically becomes so intense that the rotating hot pipe may be drawn into the induction heater at a rate which is faster than the axial advancing means is pushing the rotating pipe. When this occurs, the residence time of the hot rotating pipe within the induction heating coil may become insufficient to allow the proper amount of sprayed metal powder to reach the internal surface of the pipe, thereby causing insufficient coating thickness to be fused to the inside surface of the pipe in at least some regions of the pipe bore.

Accordingly, it is an object of the present invention to provide a method and apparatus for internally coating the surfaces of elongated metal bodies, such as tubes and pipes, without encountering wide variations in the coating thickness on the internal surface of the metal bodies.

It is another object of the present invention to provide a method and apparatus for internally coating a metal pipe or tube without encountering wide variations in the speed of the rotating tube or pipe as it is passed through an induction heating apparatus.

It is also an object of the present invention to provide a method and apparatus for internally coating a metal tube or pipe without encountering an excessive speed of advance of the tube or pipe as it is passed through an induction heating apparatus while rotating and longitudinally advancing along the sequence of nesting grooves between the adjacent pairs of rollers on the outlet side of the induction heating apparatus.

It is a further object of the present invention to provide a method and apparatus for internally coating a rotating metal tube or pipe at a substantially constant speed of advance which is sufficient to cause the rotating and longitudinally advancing metal tube or pipe to achieve a substantially uniform coating thickness which is substantially uninfluenced by any magnetic field which may be imposed upon the advancing pipe as it is passed through an induction heating coil.

These and other objects of the present invention, as well as the advantages thereof, will become more clear to those skilled in the art from the disclosure which follows.

SUMMARY OF THE INVENTION

It has now been discovered that as a rotating pipe or tube of carbon steel is passed axially through an induction coil heating apparatus and sequentially along the nesting grooves between adjacent pairs of rollers on the outlet side of the heating apparatus, the rotating pipe first moves very rapidly, then begins to move less rapidly, and finally begins moving slowly, until about one third of the length or mass of the rotating pipe has passed through the induction coils of the heater. At this point, the induced magnetic field no longer seems to effect the speed of the advancing rotating pipe. Generally, the axial advancing means or pusher element catches up to the trailing end of the rotating pipe on the inlet side of the induction heating apparatus at a time prior to this time, because the hot pipe has elongated axially due to the coefficient of expansion of the carbon steel. The pusher element then pushes the remainder of the rotating pipe or tube through the induction heating apparatus at a constant speed so that at least the last two thirds of the pipe or tube will have a uniform coating deposited on the internal surface.

Accordingly, it has now become recognized that this variation in the speed at which the rotating pipe or tube advances through the coils of the induction heater cannot be tolerated, and that the speed at which the pipe or tube advances through the induction heater must be maintained under positive control if a uniform thickness is to be achieved for the internal metal coating. Therefore, the present invention provides method and apparatus concepts which compensate for the influence of the magnetic field which is imposed on the rotating pipe or tube as it is passed axially through the induction heating apparatus and sequentially along the nesting grooves between adjacent pairs of outlet rollers.

Accordingly, in its broad method aspects, the present invention comprehends a method for processing an elongated metallic workpiece which includes the step of passing the workpiece through an induction heating device by means of an axial advancing device for longitudinally advancing the metallic workpiece through the induction heating device, and restraining the advancement of the metallic workpiece on the outlet side of said induction heating device to a predetermined rate of speed sufficient to accomplish the necessary work upon the workpiece and to thereby overcome thermal and magnetic effects of the induction heating device which would otherwise advance the metallic workpiece faster than the speed of the axial advancing device.

Additionally, in its apparatus aspects, one embodiment of the present invention comprehends an apparatus for coating the inside surface of an elongated tubular body which includes a plurality of first rollers mounted on a first rotatable shaft having an inlet end and an outlet end, and a plurality of second rollers mounted on a second rotatable shaft having an inlet end adjacent to the inlet end of the first rotatable shaft, and having a outlet end adjacent to the outlet end of the first rotatable shaft, with each second roller being spaced from and adjacent to a corresponding first roller in a paired relationship to thereby define a gap of fixed dimension between paired first and second rollers. A heating means is located proximate the outlet ends of the first and second shafts for heating an elongated tubular body passing therethrough, the heating means having an inlet side and an outlet side. A plurality of third rollers is mounted on a third rotatable shaft having an inlet end adjacent to the heating means and an outlet end spaced from the heating means. A plurality of fourth rollers is mounted on a fourth rotatable shaft having an inlet end adjacent to the heating means and adjacent to the inlet end of the third rotatable shaft, and having an outlet end adjacent to the outlet end of the third rotatable shaft, with each fourth roller being spaced and adjacent to a corresponding third roller in a paired relationship to thereby define a gap between the paired third and fourth rollers. A nesting groove is located above the gap between each set of paired rollers and between the adjacent portion of the upper surfaces of each set of paired rollers. The apparatus further includes a first motive means for rotating the first and second rotatable shafts and the mounted first and second rollers to thereby rotate an elongated tubular body within the nesting grooves of adjacent pairs of first and second rollers. A second motive means is also included for rotating the third and fourth rotatable shafts and the mounted third and fourth rollers to thereby rotate an elongated tubular body within the nesting grooves of adjacent pairs of third and fourth rollers. An axial advancing means is also included for longitudinally advancing a rotating elongated tubular body sequentially along and within the nesting grooves of adjacent pairs of first and second rollers, through the heating means, and sequentially along and within the nesting grooves of adjacent pairs of third and fourth rollers. A means for internally coating an elongated tubular body passing through the heating means with a coating material is further located within the coating apparatus. Finally, a holdback means is found on the outlet side of the heating means for restraining the advancement of a rotating elongated tubular body along the nesting groove of adjacent pairs of third and fourth rollers to a predetermined rate of speed sufficient to insure that the internal coating means will apply a uniform thin coating of the coating material to the inside surface of the advancing tubular body.

In another embodiment, the present invention comprehends an apparatus for receiving a heated elongated cylindrical body from a heating means which comprises a heating means for heating a rotating elongated cylindrical body passing therethrough, the heating means having an inlet side and an outlet side. A plurality of first rollers is mounted on a first rotatable shaft having an inlet end proximate the heating means outlet side and an outlet end spaced from the heating means outlet side. The apparatus also includes a plurality of second rollers mounted on a second 15 rotatable shaft having an inlet end adjacent to the heating means outlet side and adjacent to the inlet end of the first rotatable shaft, and having an outlet end adjacent the outlet end of the first rotatable shaft, with each second roller being spaced from and adjacent to a corresponding first roller of equal diameter in a paired relationship to thereby define a gap between paired first and second rollers. A nesting groove is located above the gap between set of paired rollers and between the adjacent portion of the upper surfaces of each set of paired rollers. Motive means is provided for rotating the first and second rotatable shafts and the mounted first and second rollers to thereby rotate a cylindrical body within the nesting grooves of adjacent pairs of first and second rollers. An axial advancing means is provided for longitudinally advancing a rotating cylindrical body through the heating means and sequentially along and within the nesting grooves of adjacent pairs of first and second rollers. Finally, a holdback means is included on the outlet side of the heating means for restraining the advancement of a rotating elongated cylindrical body along the sequence of the nesting grooves of adjacent pairs of rollers to a predetermined rate of speed sufficient to thereby overcome thermal and magnetic effects of the heating means which would otherwise advance the cylindrical body faster than the speed of the axial advancing means.

In a further embodiment, the present invention comprehends an apparatus for processing an elongated metallic workpiece which includes the step of passing the workpiece through an induction heating device by means of an axial advancing device for longitudinally advancing the metallic workpiece through the induction heating device, wherein the apparatus includes the improvement which comprises a holdback means on the outlet side of the induction heating device for restraining the advancement of the metallic workpiece to a predetermined rate of speed sufficient to accomplish the necessary work upon the workpiece and to thereby overcome thermal and magnetic effects of the induction heating device which would otherwise advance the metallic workpiece faster than the speed of the axial advancing device.

In addition, the present invention comprehends the methods which are involved in operating the various embodiments of the apparatus inventions.

A clearer understanding of the present invention will b obtained from the disclosure which follows when read in light of the accompanying drawings.

DESCRIPTION OF THE PREFERRED EMBODIMENTS

Figures 1, 2, 3, 4, 5:
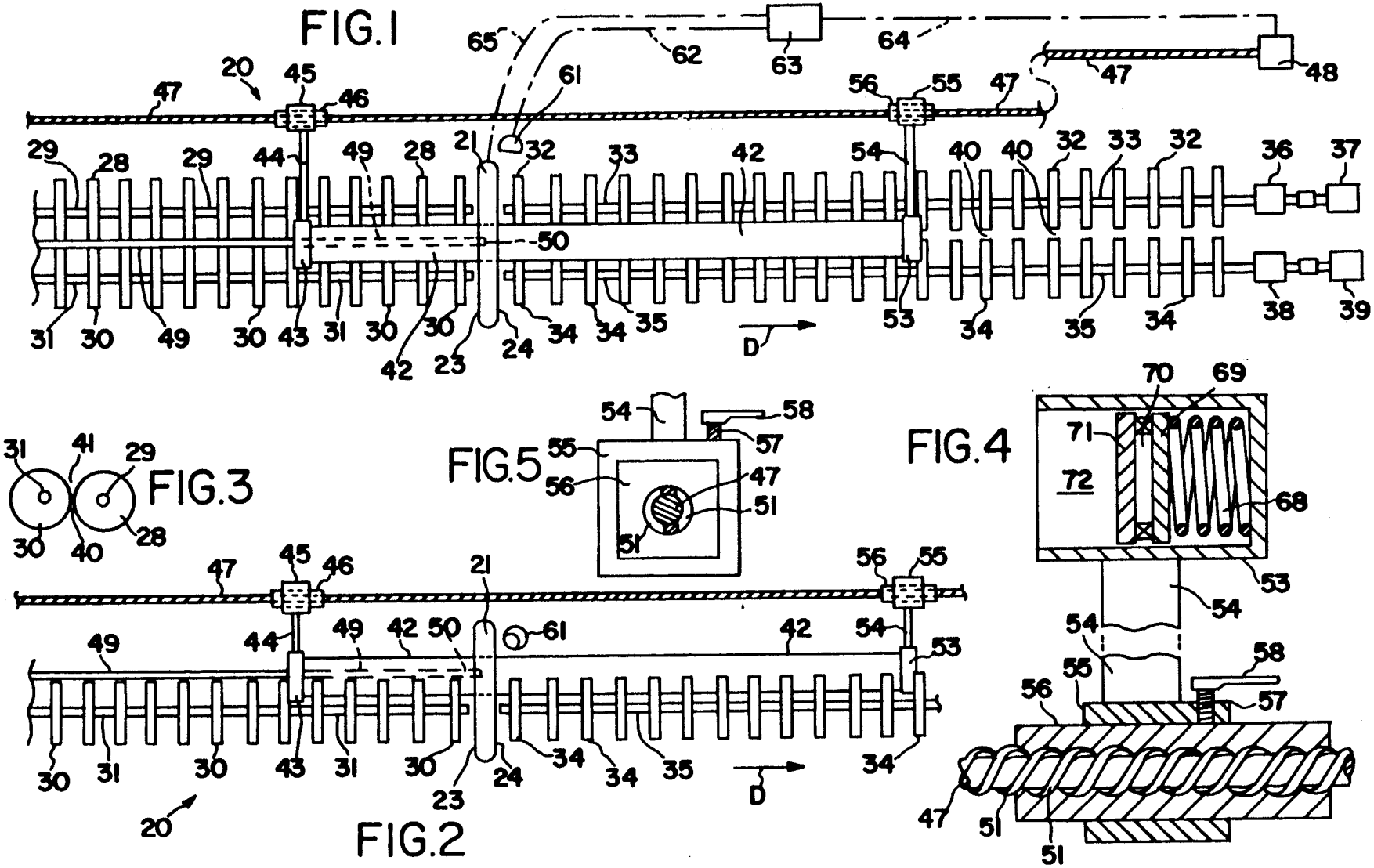
FIG. 1 is a simplified schematic representation, in a partial plan view, of an apparatus for spray coating the interior surface of a rotating longitudinally advancing pipe or tube in accordance with the present invention.
FIG. 2 is a simplified schematic representation of a central portion of the apparatus of FIG. 1, presented in a partial left side elevational view.
FIG. 3 is a simplified schematic representation of an end view of a pair of rollers as seen from the output end of the apparatus of FIG. 1, showing the gap between paired rollers and the nesting groove above the gap.
FIG. 4 is a simplified schematic representation, shown as a sectional side view, of an embodiment of a holdback device on the outlet side of the heating apparatus of FIGS. 1 and 2.
FIG. 5 is a simplified schematic representation of the end view for a lower portion of the device of FIG. 3.

Referring now to FIGS. 1 and 2, there is shown a metal coating apparatus 20 in accordance with the present invention. The apparatus 20 includes an induction heating device 21 which contains a generally circular induction coil 22 having one or more circular windings. The induction heating device has an inlet side 23 and an outlet side 24. On the inlet side of the induction heater device there is located a plurality of right inlet rollers 28 mounted on a rotatable right inlet roller shaft 29, and a plurality of left inlet rollers 30 mounted on a rotatable left inlet roller shaft 31. On the outlet side of the induction heating device 21 there is a plurality of right outlet rollers 32 mounted on a rotatable right outlet roller shaft 33, and a plurality of left outlet rollers 34 mounted on a rotatable left outlet roller shaft 35.

At the far end of the rotatable shaft 33 is a right outlet roller variable speed transmission 36 which is coupled to shaft 33 on one side and to a right outlet roller electrical drive motor 37 on the other side. At the far end of the left outlet roller shaft 35 is a left outlet roller variable speed transmission device 38 which is coupled to shaft 35 on one side and to a left outlet roller electrical drive motor 39 on the other side. In an alternate embodiment, not shown, the variable speed transmission devices 36 and 38 may be eliminated by providing that the right outlet roller electrical drive motor 37 and the left outlet roller electrical drive motor 39 are each coupled directly to the outlet roller shafts 33 and 35, respectively, in which case both drive motors are variable speed motors. Equivalent motive means are coupled at the inlet ends of inlet roller shafts 29 and 31, but they are not shown in the drawings since they are to the far left of FIGS. 1 and 2.

In an alternative arrangement, roller shafts 29 and 33 may be the end sections of a single common shaft or they may be two shafts coupled together so that motor 37 and transmission 36 drive both shafts. Similarly, roller shafts 31 and 35 may be the end sections of a single common shaft or they may be two shafts coupled together so that motor 39 and transmission 38 drive both shafts.

In any event, all motive means are operatively coupled to conventional control means which rotate the roller drive shafts 29, 31, 33 and 35 in unison in a manner sufficient to provide that a rotating elongated tubular body passing from the first and second inlet rollers 28 and 30 and through the heater 21 will continue to rotate at the same speed and in the same direction as it enters upon the outlet rollers 32 and 34.

It will be recognized that FIGS. 1 and 2 are simplified schematic representations of the apparatus configuration. Various standard elements of the machine, such as the machine frame with supporting brackets, pedestals, bearings, thrust bearings, and the like have been omitted from FIGS. 1 and 2 for purposes of clarity. Similar omissions are made in FIGS. 3 through 5 for the same purpose of clarity.

FIGS. 1 and 2 show a cylindrical tube or pipe 42 which is rotating within the nesting grooves between the rotating paired rollers in the bed of the plurality of rollers hereinabove described. This can be more readily understood by referring now to FIG. 1. In FIG. 1 there is shown the opposing pairs of rotating outlet rollers 32 and 34, which are rotating upon their rotatable shafts 33 and 35, respectively. The opposing outlet rollers 32 and 34 are spaced apart to provide a gap 40 between the right outlet roller 32 and the left outlet roller 34. Above each gap 40 is a corresponding nesting groove for the pipe 42. The nesting groove 41, not seen in FIG. 1, is the open space above gap 40 and over the rotating adjacent upper surfaces of the outlet rollers 32 and 34, upon which pipe 42 is supported and rotated. Similarly, each pair of inlet rollers 28 and 30 has a gap 40 and a nesting groove 41 within which pipe 42 is supported and rotated, as shown in FIG. 3.

As the cylindrical tube or pipe 42 is rotated within the nesting grooves 41 of the array of rollers, it is also advanced longitudinally or axially within the sequence of nesting grooves between the paired rollers by means of an advancing means or pusher unit, as shown by the directional arrow D in FIGS. 1 and 2. The pusher unit includes a pusher head 43, within which is held the rear or trailing end of the pipe or tube 42. The pusher head has an annular cup-shaped configuration, and it is attached to an elongated pusher arm 44, which in turn is attached to an adjustable collar 45, which is slidably mounted on a shoulder element 46. Shoulder element 46 contains a bore which has a recessed helical inside thread in mating relationship with a helical screw thread on the outer surface of a reversibly rotatable drive shaft 47. The helical screw drive shaft 47 is driven by a motive means, such as a reversible variable speed motor 48, which is attached to the end of the drive shaft 47, as shown to the far right of FIG. 1.

A powdered metal feed line 49 extends above the plurality of rotating right inlet rollers 28 and left inlet rollers 30 and over the plurality of nesting grooves therebetween. Feed line 49 passes through a central opening in the annular cup-shaped pusher head 43, and it enters the trailing end of the longitudinally moving pipe or tube 42. The powdered metal feed line 49 conveys a suspension of powdered metal in a non-oxidizing gas, such as nitrogen, helium, or argon, and it is supplied from a conventional source which is not shown since it is to the far left in FIGS. 1 and 2. The powdered metal suspension is sprayed onto the inside surface of the rotating pipe or tube 42 by means of a spray nozzle 50 located within the induction heating apparatus 21. It will be noted that as the pipe 42 advances longitudinally in the sequence of nesting grooves 41 between the array of inlet rollers 28 and 30, it passes over and encompasses the feed line 49 and spray nozzle 50. As it moves through the induction heating coil 22, thermal excitation of the pipe metal and the sprayed powdered coating metal occurs, so that the powdered metal sprayed on the inside surface of the pipe 42 becomes melted, is evenly distributed on the inner surface of pipe 42 by the centrifugal force which is caused by the rotation of the pipe 42, and is then fused to the inside surface of the pipe 42 in a uniform thin layer as the hot rotating pipe cools while passing down the sequence of nesting grooves on the outlet rollers 32 and 34.

Assuming a typical carbon steel pipe 42, and further assuming that the powdered metal which is sprayed from nozzle 50 within the induction heater 21 is a chrome alloy for imparting corrosion resistance to the inside surface of the pipe 42, the induction heating coil 22 will impose upon the carbon steel pipe 42 a temperature in the range of from about 1950° F. to 2300° F., or even more. This elevated temperature is necessary in order to cause the chrome alloy to melt and spread evenly along the inside surface of the rotating pipe 42 as it is moved longitudinally over the stationary spray head 50.

Due to the sudden elevation of temperature from ambient to the elevated temperature which is needed to melt the coating powder, the pipe 42 experiences rapid thermal elongation as it exits from the induction heating device 21. Moreover, the induction heater 21 imposes a magnetic field upon the pipe 42 which is strong enough to draw the pipe 42 through the heater faster than the speed which is required for proper internal coating of the pipe, as previously discussed.

Accordingly, a holdback device restrains the leading end of the pipe 42, as shown in FIGS. 1 and 2. The holdback device includes a holdback head 53, within which is held the front or leading end of the pipe or tube 42. The holdback head has an annular cup-shaped configuration, and it is attached to an elongated holdback arm 54, which in turn is attached to an adjustable collar 55, which is slidably mounted on a shoulder element 56. Shoulder element 56 contains a bore which has a recessed helical inside thread in mating relationship with a helical screw thread on the outer surface of the reversibly rotatable drive shaft 47.

The structure of the holdback device is more clearly shown in FIGS. 4 and 5. Referring to FIG. 4, there is shown the holdback head 53 which is supported upon the elongated holdback arm 54. The holdback arm 54 is mounted on the adjustable collar 55 which is slidably movable upon the shoulder element 56. The shoulder element 56 contains a bore which has a helical inside thread in mating relationship with the helical thread 51 on the outer surface of the helical screw drive shaft 47. The helical thread on the outer surface of shaft 47 may be a single helical thread 51 or it may be multiple helical threads located upon the outer surface. For purposes of illustration, FIG. 4 shows two individual helical threads 51 on the outer surface of drive shaft 47 in mating relationship with two helical thread recesses in the inside surface of shoulder element 56.

The holdback head 53 contains a biasing spring 68, preferably in the form of a helical coil spring, as shown. A nonrotatable backing plate 69 is fixedly attached to the biasing spring 68. An annular bearing element 70 is mounted on the nonrotatable fixed backing plate 69. The annular bearing element 70 in turn is fixed to a rotatable holdback pad 71, which is rotatably mounted on the bearing element for contact with the rotating leading end of a pipe 42. The holdback head further contains a holdback recess 72 for receiving and retaining the rotating leading end of the pipe 42.

Positioning of the holdback device within the coating apparatus is accomplished by two means. For a coarse adjustment, the shoulder element 56 may be moved to the right or to the left upon the helical screw drive shaft 47, thus enabling the holdback device to be moved closer to the induction heater 21 or further away from the heater unit. The slidable adjustable collar 55 provides a fine adjustment for then locating the holdback head exactly in the desired position, once the shoulder element 56 has been brought into a close position within the coating apparatus. The adjustable collar 55 may be quickly slid to the right or to the left to obtain the fine adjustment of the exact position for the holdback head. For this rapid adjustment of the position of the adjustable collar 55, a locking screw 57 is provided which has a set screw handle 58 mounted on the external end. The handle 58 allows for rapid unscrewing of the set screw 57 so that the collar 55 may be quickly moved into the exact position. A turn of the handle 58 in the other direction then moves the set screw 57 against the movable shoulder element 5 for rapid locking of the adjustable collar 5 into final position.

FIG. 5 illustrates an end view of the lower portion of the device of FIG. 4, showing the elongated holdback arm 54, the slidably adjustable collar 55, and the movable shoulder element 56, which are mounted upon the helical screw drive shaft 47 which has the two helical external threads 51. It can be seen from FIG. 5 that the slidably adjustable collar 55 and the movable shoulder element 56 are formed of bar stock having a square cross-section. This is for the convenience of fabrication, since the structure of the slidably adjustable collar 55 and the movable shoulder element 56 may optionally be that of concentric cylinders.

It is to be noted that the helical screw drive shaft 47 is located above the pusher head 43 and the holdback head 53 in FIG. 2, while the drive shaft 47 is shown below the holdback head 53 in FIG. 4. Although either location is suitable, the preferred option is to locate the drive shaft 47 below the pusher head 43 and the holdback head 53. This is because the lower position provides easier access to the slidably adjustable collars 45 and 55, and to the set screws 57 with locking handles 58 which are contained in adjustable collars 45 and 55.

It is also to be noted that the single helical screw shaft 47 acts as the motive means or drive shaft for both the pusher head 43 and the holdback head 53. It is further within the scope of the present invention to use two helical drive shafts, with the pusher head 43 mounted upon the helical shaft 47 and driven by the reversible variable speed motor 48, and with the holdback head 53 mounted on a second and independent drive shaft which is driven by a second reversible variable speed motor. In addition, it is within the scope of this invention to provide that both the pusher head 43 and the holdback head 53 are structurally connected together so that only one shoulder element is mounted on helical drive shaft 47 for movement of both heads 43 and 53. For example, the axial advancing means which comprises pusher head 43, arm 44, slidably movable collar 45, and shoulder element 46 would be as shown in FIGS. 1 and 2. A bar or equivalent support would fixedly extend from the pusher arm 44 or the collar 45 to the holdback device. The holdback device would then consist of the holdback head 53 mounted on holdback arm 54, which is attached to slidable adjustable collar 55, which is mounted on shoulder element 56, which is supported in a mating engagement with a portion of the support bar having a helical screw thread on an outer surface. Alternatively, the slidably adjustable collar 55 may be mounted 22directly on the extended supporting bar in slidable engagement with a smooth outer surface thereof, in which case the holdback shoulder element 56 may be eliminated.

The structure for the axial advancing means on the inlet side of the induction heater 21 is virtually identical to the structure for the holdback means on the output side of heater 21, which is shown in FIGS. 4 and 5. Thus, the annular cup-shaped pusher head 43 is virtually identical to the holdback head 53, the elongated pusher arm 44 is similar to the arm 54, the slidably adjustable collar 45 is similar to collar 55, and the movable shoulder element 46 is similar to the shoulder element 56. In addition, the adjustable collar 45 contains a set screw 57 with a handle 58, as shown in FIG. 4, for locking the slidable collar 45 upon the movable shoulder element 46. Also, the pusher head 43 contains a biasing spring means 68, a nonrotatable holdback plate 69 fixedly attached to the spring 68, an annular bearing element 70 mounted on the backing plate 69, and a rotatable pusher pad 71 which is rotatably mounted on the bearing element 70. The differences between the structure of the holdback device of FIG. 4 and the pusher device which is shown in FIGS. 1 and 2, is that in the pusher device the open face for receiving the trailing end of the pipe 42 in the recess 72 faces to the right, instead of to the left as is shown for the holdback head 53. In addition, the bottom of the cup-shaped pusher head 43 has a central opening for passage of the pipe 49 for conducting the gas suspension of powdered metal to the spray nozzle 50. Similarly, the backing plate 69 and the rotatable pusher pad 71 of the pusher head 43 contain an equivalent bore for passage of the pipe 49 therethrough.

To initiate operation of the coating apparatus, the helical screw shaft 47 is rotated to move the shoulder elements 46 and 56 toward the inlet end of the apparatus (that is, to the left). The rotation of the shaft 47 continues until the holdback shoulder element 56 is adjacent to the induction heater 21 at the outlet side 24, while the pusher shoulder element 46 is spaced away from the heater inlet side 23. The pusher head 43 is thereby spaced away from the induction heater 21 by a distance which is equal to the length of the pipe 42 which is to be internally coated, plus a relatively short distance to allow for the thermal elongation of the pipe 42 as it is heated. This means that at the beginning of operation, the holdback head 53 is adjacent the outlet side 24 of the induction heater 21. The leading end of the pipe 42 is manually placed upon the array of inlet rollers 28 and 30, with the leading end adjacent to the induction heater 21 on the inlet side 23. The trailing end of the pipe 42 is spaced away from the induction heater 21, and the pusher head 43 is spaced away (to the right) from the trailing end of the pipe 42. The array of rollers is then rotated at the required rpm and the induction heater 21 is energized. The temperature rises and the magnetic field increases.

After a given time interval, the temperature will reach a level which is sufficient to melt the coating metal powder which is to be sprayed into the inside of the pipe, and the magnetic field will reach an intensity sufficient to begin to pull the pipe through the heating element 21 for engagement with the holdback head 53. The spray device 50 then begins depositing metal powder on the inside surface of the rotating pipe 42. As the pipe is induced to pass through the induction heater 21 by the magnetic field, the helical screw shaft 47 is rotated at a speed which is sufficient to move the holdback head 53 and the pusher head 43 at a constant speed which has been predetermined in order to insure that a proper coating operation will be obtained. When the advancement of the holdback head 53, with the leading end of the rotating pipe 42 contained within the recess 72, has reached a position which provides that about one-third of the pipe 42 is now on the outlet side of the heating element 21, the pipe has expanded due to the thermal coefficient of expansion so that the trailing end of the pipe 42 is now held within the recess 72 of the pusher head 43. At this point, the biasing springs 68, which are contained within the pusher head 43 and the holdback head 53, provide a self-adjusting positioning of the pipe so that the actual calculation of the dimensions of thermal elongation for the pipe 42 need not be perfectly exact. Thus, the biasing springs 68 make the unit self-compensating for minor errors in calculating the expanded length of the hot pipe.

Those skilled in the art will readily recognize that the operation of the holdback system easily lends itself to computer control. This is illustrated in FIGS. 1 and 2 where a temperature sensing and signal generating means 61 is shown. The temperature sensing means is typically an optical pyrometer such as an infrared sensor. The infrared sensor 61 may detect a single frequency of infrared radiation, or it may detect two distinct frequencies of IR radiation, in which case it is known as a "two-color" IR sensor. The IR sensing device 61 is focused upon the infrared radiation which emanates from the hot pipe which is being discharged from the induction heater 21. The temperature which is sensed at the point where the hot pipe 42 leaves the heater 21 generates temperature signals which are transmitted via a transmission means 62 to an electronic computer or microprocessor 63, which is programmed to activate control systems responsive to the sensed temperatures. For this purpose, signals are generated by the computer or microprocessor 63 and passed via transmission means 64 to the reversible variable speed motor 48. The motor 48 responds to the signals received via transmission means 64 to continuously adjust the speed at which the helical screw drive shaft 47 is rotated. This insures that the advance of the pusher head 43 toward the induction heater 21, and the withdrawal of the holdback head 53 from the induction heater 21, are maintained at a constant predetermined speed in response to the temperature level of the hot pipe 42. In addition, the electronic computer or microprocessor 63 may send a temperature adjustment signal via transmission means 65 to the induction heating unit 21 for fine tuning the electrical power passing to the induction coils.

The actual amount of thermal expansion (elongation) of the hot pipe, as well as the strength of the induced magnetic field, will depend upon a number of parameters. Among the parameters which will influence the elongation of the pipe, and the influence of the induced magnetic field upon the pipe, are the diameter of the metal pipe, its wall thickness, the length of the pipe, the composition of the metal pipe, the composition of the powdered coating being fused to the inside surface of the metal pipe, the speed of rotation of the pipe (rpm), the speed or rate of travel of the metal pipe longitudinally along the sequence of nesting grooves, the electrical power passing to the induction heater for providing the coating temperature, the level of the ambient room temperature, etc. Typically, the coating operation involves the thermal processing of a carbon steel pipe using an induction heater of high power input, such as 200 kilowatts, in a commercial coating operation. In general, coating operations have been conducted using carbon steel pipe having a nominal pipe size of from 2 to 15 inches.

Although the various aspects of the present invention have been described with preferred embodiments illustrated herein, it is to be understood that modifications and variations may be resorted to without departing from the spirit and scope of this invention. As those skilled in the art will readily understand, such modifications and variations are considered to be within the purview and the scope of the appended claims.

The invention claimed is:

1. A coating apparatus for coating an inside surface of an elongated, rotating, tubular body having a longitudinal axis and a coating material inside which is to be heated and melted inside the tubular body to coat the same, the apparatus comprising:

a heating means for heating the tubular body and melting the coating material;

an inlet side on the heating means through which the rotating tubular body passes;

an outlet side of the heating means from which the rotating tubular body passes;

means for rotating the tubular body about its longitudinal axis and to spread the melted coating material on the inside of the tubular body;

an axial advancing means for longitudinally advancing the tubular body through the heating means at a predetermined speed;

inlet rollers on the inlet side of the heating means for supporting the tubular body for rotation about the longitudinal axis of the portion of the tubular body and for longitudinal advancement through the heating means;

outlet rollers on the outlet side of the heating means for supporting the tubular body for rotation and for longitudinal advancement after the tubular body passes through the heating means;

said heating means comprising a heating coil encircling the rotating tubular body and developing an electromagnetic force urging the tubular body to travel at a faster speed forwardly; and holdback means for restraining the advancement of the tubular body by the electromagnetic force and for maintaining the predetermined speed for the tubular body in its travel through the heating coil.

2. Coating apparatus according to claim 1 wherein applicator means particulate coating material to the inside surface of said rotating elongated tubular body passing through said heating means.

3. Coating apparatus according to claim 2 wherein said applicator means comprises a particulate spray nozzle discharging a suspension of said particulate coating material in a nonoxidizing gas.

4. Coating apparatus according to claim 3 wherein said spray nozzle is located proximate said heating means inlet side.

5. Coating apparatus according to claim 4 wherein said spray nozzle is located within said heating means.

6. Coating apparatus according to claim 3 wherein said spray nozzle is supplied said suspension of particulate coating material by a feed conduit suspended above the inlet rollers.

7. Coating apparatus according to claim 6 wherein said rotating elongated tubular body is advanced along said inlet rollers with said feed conduit contained within said tubular body.

8. Coating apparatus according to claim 1 wherein said heating means comprises an induction heater.

9. Coating apparatus according to claim 8 wherein said induction heater includes a substantially circular induction coil between said inlet and outlet sides which imposes a magnetic field upon said advancing tubular body which is sufficient to draw at least a leading portion of said tubular body through said induction heater.

10. Coating apparatus according to claim 1 further including temperature sensing means for determining the temperature of a rotating elongated tubular body exiting the outlet side of said heating means, means for generating signals indicative of sensed temperatures, first signal transmission means for receiving and transmitting temperature signals from said signal generating means, electronic computer means receiving said temperature signals from said first signal transmission means, second signal transmission means for receiving and transmitting speed control signals from said electronic computer means, and holdback motive means for receiving said speed control signals from said second signal transmission means and responsively controlling said predetermined rate of speed.

11. Coating apparatus according to claim 1 wherein first and second motive means rotate said inlet and outlet rollers in a manner sufficient to provide that a rotating elongated tubular body leaving the inlet rollers continues to rotate at the same speed and in the same direction as it enters the outlet rollers.

12. Coating apparatus according to claim 1 wherein said holdback means further includes holdback motive means for withdrawing said holdback head from said heating means outlet side at said predetermined rate of speed.

13. Coating apparatus according to claim 12 wherein said holdback motive means also advances said axial advancing means toward said heating means inlet side at said predetermined rate of speed.

14. Coating apparatus according to claim 1 wherein said axial advancing means includes a pusher head having an annular cupshaped structure including a recess for receiving and retaining a rotating trailing end of an elongated tubular body advancing toward the inlet side of said heating means.

15. Coating apparatus according to claim 14 wherein said axial advancing means further includes advancing motive means for advancing said pusher head toward said heating means inlet side.

16. Coating apparatus according to claim 15 wherein said advancing motive means advances said axial advancing means toward said hating means inlet side at said predetermined rate of speed.

17. Coating apparatus according to claim 14 wherein said recess contains a rotatable holding pad for rotatable contact with said rotating trailing end.

18. Coating apparatus according to claim 17 wherein said rotatable holding pad is mounted on a biasing means for maintaining said holding pad in rotatable contact with said rotating trailing end.

19. Coating apparatus for coating the inside surface of an elongated tubular body which comprises:

a.) a plurality of first rollers mounted on a first rotatable shaft having an inlet end and an outlet end;

b.) a plurality of second rollers mounted on a second rotatable shaft having an inlet end adjacent the inlet end of said first rotatable shaft, and having an outlet end adjacent the outlet end of said first rotatable shaft, with each second roller being spaced from and adjacent to a corresponding first roller in a paired relationship to thereby define a gap between paired first and second rollers;

c.) electric heating means proximate the outlet ends of said first and second shafts for heating an elongated tubular body passing therethrough, said heating means having an inlet side and an outlet side;

d.) a plurality of third rollers mounted on a third rotatable shaft having an inlet end proximate said heating means and an outlet end spaced from said heating means;

e.) a plurality of fourth rollers mounted on a fourth rotatable shaft having an inlet end adjacent said heating means and adjacent the inlet end of said third rotatable shaft, and having an outlet end adjacent the outlet end of said third rotatable shaft, with each fourth roller being spaced from and adjacent to a corresponding third roller in a paired relationship to thereby define a gap between paired third and fourth rollers;

f.) a nesting groove above the gap between each set of paired rollers and between the adjacent portion of the upper surfaces of each set of paired rollers;

g.) first motive means for rotating said first and second rotatable shafts and said mounted first and second rollers to thereby rotate an elongated tubular body within the nesting grooves of adjacent pairs of first and second rollers;

h.) second motive means for rotating said third and fourth rotatable shafts and said mounted third and fourth rollers to thereby rotate an elongated tubular body within the nesting grooves of adjacent pairs of third and fourth rollers;

i.) axial advancing means for longitudinally advancing a rotating elongated tubular body sequentially along and within the nesting grooves of adjacent pairs of first and second rollers, through said heating means, and sequentially along and within the nesting grooves of adjacent pairs of third and fourth rollers;

j.) means for internally coating an elongated tubular body passing through said heating means with a coating material; and, k.) holdback means on the outlet side of said heating means for restraining the advancement of a rotating elongated tubular body along the sequence of nesting grooves of adjacent pairs of third and fourth rollers to a predetermined rate of speed sufficient to insure that said internal coating means will apply a uniform thin coating of said coating material to the inside surface of the advancing tubular body despite thermal and magnetic effects of said electric heating means upon said tubular body, said holdback means including a holdback head having an annular cup-shaped structure including a recess for receiving and retaining a rotating leading end of an elongated tubular body exiting form the outlet side of said heating means.

20. Coating apparatus according to claim 19 wherein said recess contains a rotatable holding pad for rotatable contact with said rotating leading end.

21. Coating apparatus according to claim 20 wherein said rotatable holding pad is mounted on a biasing means for maintaining said holding pad in rotatable contact with said rotating leading end.

22. Apparatus for receiving a heated elongated cylindrical body from a heating means which comprises:

a.) electric heating means for heating a rotating elongated cylindrical body passing therethrough said heating means having an inlet side and an outlet side;

b.) a plurality of first rollers mounted on a first rotatable shaft having an inlet end proximate said heating means outlet side and an outlet end spaced from said heating means outlet side;

c.) a plurality of second rollers mounted on a second rotatable shaft having an inlet end adjacent said heating means outlet side and adjacent the inlet end of said first rotatable shaft, and having an outlet end adjacent the outlet end of said first rotatable shaft, with each second roller being spaced from and adjacent to a corresponding first roller in a paired relationship to thereby define a gap between paired first and second rollers.

d.) a nesting groove above the gap between each set of paired rollers and between the adjacent portion of the upper surfaces of each set of paired rollers;

e.) motive means for rotating said first and second rotatable shafts and said mounted first and second rollers to thereby rotate a cylindrical body within the nesting grooves of adjacent pairs of first and second rollers;

f.) axial advancing means for longitudinally advancing a rotating cylindrical body through said heating means and sequentially along and within the nesting grooves of adjacent pairs of first and second rollers; and, g.) holdback means on the outlet side of said heating means for restraining the advancement of a rotating elongated cylindrical body along the sequence of nesting grooves of adjacent pairs of rollers to a predetermined rate of speed sufficient to overcome thermal and magnetic effects of said heating means which would otherwise advance said cylindrical body faster than the speed of said axial advancing means, h.) coating means for coating the cylindrical body while it is rotating;

said holdback means including a holdback head having an annular cup-shaped structure including a recess for receiving and retaining a leading end of an elongated metallic workpiece exiting from the outlet side of said induction heating device.

23. Coating apparatus according to claim 22 wherein said holdback means further includes holdback motive means for withdrawing said holdback head from said heating means outlet side at said predetermined rate of speed.

24. Coating apparatus according to claim 23 wherein said holdback motive means also advances said axial advancing means toward said heating means inlet side at said predetermined rate of speed.

25. Coating apparatus according to claim 23 wherein said recess contains a rotatable holding pad for rotatable contact with said rotating leading end.

26. Coating apparatus according to claim 25 wherein said rotatable holding pad is mounted on a biasing means for maintaining said holding pad in rotatable contact with said rotating leading end.

27. A method for processing an elongated metallic workpiece which includes:

passing the workpiece through an induction heating device, providing an axial advancing device for longitudinally advancing the metallic workpiece through said induction heating device, providing an induction heating coil in the induction heating device and advancing the workpiece through the coil with the magnetic effect of the coil advancing the workpiece faster than the speed of the axial advancing device, coating the workpiece with a coating material, and restraining the advancement of said metallic workpiece on the outlet side of said induction heating device to a predetermined rate of speed to assist in providing a uniform coating on the workpiece and to thereby overcome thermal and magnetic effects of said induction heating device which would otherwise advance the metallic workpiece faster than the speed of the axial advancing device.

* * * * *

UNITED STATES PATENT AND TRADEMARK OFFICE

CERTIFICATE OF CORRECTION

PATENT NO. : 5,202,160

DATED : April 13, 1993

INVENTOR(S) : Schuppe, et al.

It is certified that error appears in the above-identified patent and that said Letters Patent is hereby corrected as shown below:

Column 3, Line 15, change "on" to --one--.

Column 5, Line 58, change "effect" to --affect--.

Column 7, Line 27, delete "15".

Column 7, Line 35, after "between" insert --the--.

Column 8, Line 7, change "will b" to --will be--.

Column 11, Line 29, change "5" to --56--.

Column 11, Line 30, change "5" to --55--.

Column 12, Line 11, delete "22".

Column 15, Line 7, after "supplied" insert --with--.

Column 15, Line 64, change "hating" to --heating--.

UNITED STATES PATENT AND TRADEMARK OFFICE

CERTIFICATE OF CORRECTION

PATENT NO. : 5,202,160

DATED : April 13, 1993

INVENTOR(S) : James L. Schuppe, et al.

It is certified that error appears in the above-identified patent and that said Letters Patent is hereby corrected as shown below:

Column 17, Line 3, change "form" to --from--.

Signed and Sealed this

Eleventh Day of January, 1994

*Attest:*

*Attesting Officer*

BRUCE LEHMAN

*Commissioner of Patents and Trademarks*